US006643877B1

(12) United States Patent
Amtenbrink et al.

(10) Patent No.: US 6,643,877 B1
(45) Date of Patent: Nov. 11, 2003

(54) TOOL SET

(75) Inventors: Klaus Amtenbrink, Wuppertal (DE); Axel Fach, Remscheid (DE); Sylvester Rosanwo, Wuppertal (DE); Martin Strauch, Wuppertal (DE); Michael Abel, Radevormwald (DE)

(73) Assignee: Wera Werk Hermann Werner GmbH & Co. KG, Wuppertal (DE)

( * ) Notice: Subject to any disclaimer, the term of this patent is extended or adjusted under 35 U.S.C. 154(b) by 0 days.

(21) Appl. No.: 10/088,800

(22) PCT Filed: Sep. 21, 2000

(86) PCT No.: PCT/EP00/09229

§ 371 (c)(1),
(2), (4) Date: Aug. 6, 2002

(87) PCT Pub. No.: WO01/21360

PCT Pub. Date: Mar. 29, 2001

(30) Foreign Application Priority Data

Sep. 21, 1999 (DE) ..... 299 16 538 U

(51) Int. Cl.[7] ..... B25B 7/22

(52) U.S. Cl. ..... 7/125; 7/129; 7/165; 7/167; 81/177.2; 81/423; 81/489; 81/180.1

(58) Field of Search ..... 7/125, 126, 127, 7/128, 129, 130, 131, 132, 133, 134, 135, 138, 142, 158, 165, 167; 81/419–424, 427.5, 177.1, 177.2, 177.4, 177.85, 180.1, 181, 185.2, 489

(56) References Cited

U.S. PATENT DOCUMENTS

| | | | | | |
|---|---|---|---|---|---|
| 2,667,194 | A | * | 1/1954 | Fischer et al. | 81/438 |
| 4,930,377 | A | * | 6/1990 | Lester | 81/15.2 |
| 4,958,395 | A | * | 9/1990 | Busskohl | 7/145 |
| 5,014,379 | A | * | 5/1991 | Hull et al. | 7/127 |
| 5,033,140 | A | * | 7/1991 | Chen et al. | 7/127 |
| 5,062,173 | A | | 11/1991 | Collins | |
| 5,142,721 | A | | 9/1992 | Sessions | |
| 5,188,378 | A | * | 2/1993 | Erlenkeuser | 279/22 |
| 5,212,844 | A | | 5/1993 | Sessions | |
| 5,267,366 | A | | 12/1993 | Frazer | |
| 5,404,616 | A | * | 4/1995 | Carmien | 16/422 |
| 5,438,894 | A | * | 8/1995 | Pearce | 81/177.2 |
| 5,664,274 | A | | 9/1997 | Collins | |
| 5,752,285 | A | * | 5/1998 | Bendheim et al. | 7/167 |
| 5,809,600 | A | * | 9/1998 | Cachot | 7/128 |
| 5,910,174 | A | * | 6/1999 | Finn | 7/127 |
| 6,134,994 | A | * | 10/2000 | Gomas | 81/427.5 |
| 6,145,851 | A | * | 11/2000 | Heber | 279/143 |

FOREIGN PATENT DOCUMENTS

| | | |
|---|---|---|
| DE | 1721199 | 2/1906 |
| DE | 9000245 | 6/1991 |
| DE | 29902625 | 8/1999 |
| FR | 1081907 | 12/1954 |
| WO | 9818599 | 5/1998 |

* cited by examiner

*Primary Examiner*—George Nguyen
*Assistant Examiner*—Hadi Shakeri
(74) *Attorney, Agent, or Firm*—Martin A. Farber

(57) ABSTRACT

A tool set having a screwdriver handle with a chuck for insertion and latched mounting of screwing-tool inserts provided with standard polygonal shank segments, and having screwing-tool inserts, which are insertable into the chuck and are provided with the standard polygonal shank segments, in particular bits, nuts or ratchets and extensions for drive of the latter, comprising a supplementary tool which has a plier head (2) and a plier-handle projection (4) which is disposed immediately behind a knuckle joint (5) and is in form of the standard shank segment of the screwing-tool inserts, the screwdriver handle (9) latches to the plier-handle projection by its chuck (10), forming one of two plier arms and a blade extension (11) which likewise has a chuck (10), forming other of the two plier arms.

13 Claims, 6 Drawing Sheets

Fig. 8
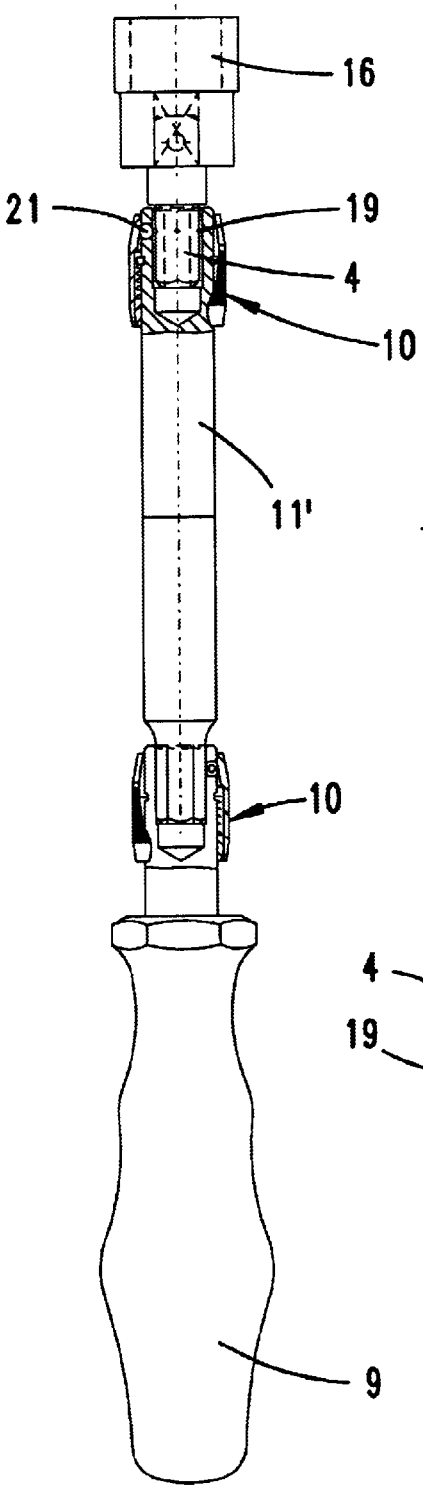
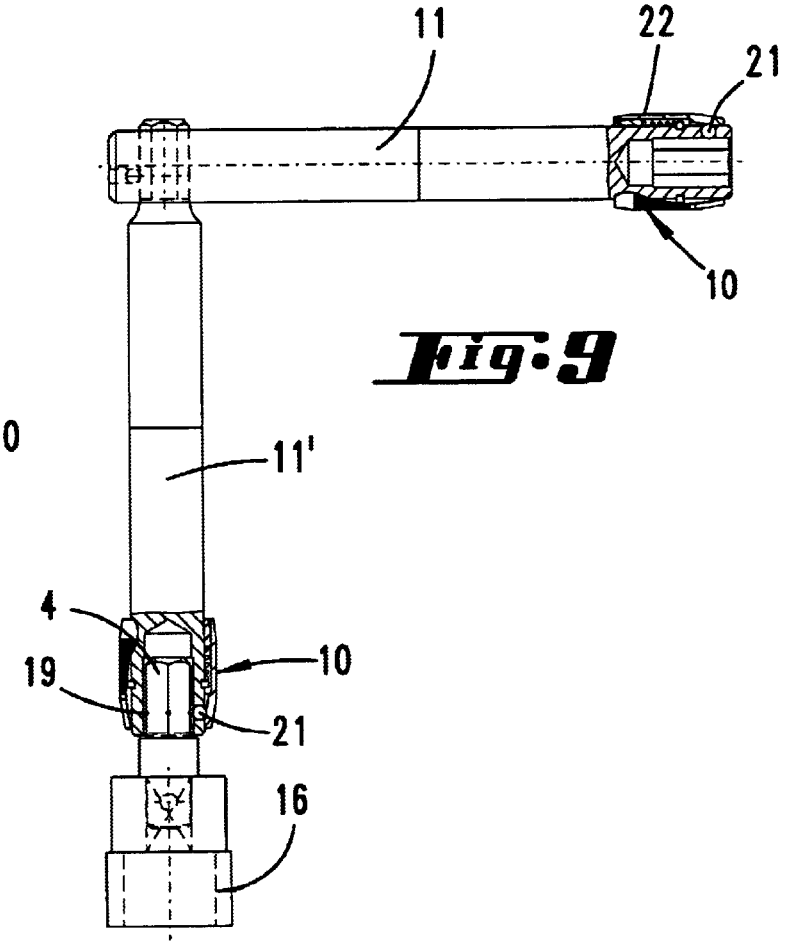
Fig. 9

TOOL SET

FIELD AND BACKGROUND OF THE INVENTION

The invention relates to a tool set having a screwdriver handle with a chuck for the insertion and latched mounting of tool inserts provided with standard polygonal-shank segments, and having tool inserts, which can be inserted into the chuck and are provided with the standard polygonal segments, in particular bits, sockets or extension elements.

Such tool sets are known in the prior art. For example, handles which have an interior cavity into which the tool inserts can be inserted for exchange purposes are already known. There are also handles which have an internal free-wheel mechanism. Overall, however, such handles are usually only combined with screwing tools. Handles with differently configured chucks have also already been fitted in practice with different tool attachments, for example German Utility Model 1721199 discloses a screwdriver handle onto which a hammer shaft can be plugged. U.S. Pat. No. 5,901,174 discloses a screwdriver handles with a specifically configured profile which can be pushed onto plier arms, the plier arms themselves being provided as screwdriver blades, so that the plier arms can be used as screwing tools when the handles are removed. U.S. Pat. No. 5,062,173, U.S. Pat. No. 5,142,721, U.S. Pat. No. 5,212,844, and U.S. Pat. No. 5,267,366 describe multifunction tools which are based on pliers with two plier-handle arms, out of which handle arms it is possible to pivot screwdriver blades , saws, knives or the like.

U.S. Pat. No. 5,664,274 describes a multipurpose tool in the form of pliers, it being possible for knife blades to be extended out of the rear of the plier arms, which can be removed from the plier head. FR 1,081,907 describes a hammer which is hollow on the inside and in which constituent parts of a plier head are accommodated. The shaft of the hammer comprises two handle segments which are located one beside the other and can be unscrewed from the hammer head in order to be screwed to the plier heads, this producing a tool in the form of pliers. Connections for connecting to screwing tools are also located to the rear of these handle segments.

SUMMARY OF THE INVENTION

It is an object of the invention to develop a tool set of the generic type, without losing the ability to combine with further screwing tools which do not belong to the tool set, such that a new functioning mode is established.

The novel solution according to the invention provides a supplementary tool which has a plier head. The special feature here is a plier-handle projection, which is disposed immediately behind the knuckle joint, and the shape of the same. This is because the shape is intended to be that of a standard shank segment of the screwing tools, the screwdriver handle, which latches to the plier-handle projection by way of its chuck, forming one of the two plier arms.

In a preferred development, this configuration makes it possible to assemble fully functional pliers exclusively with parts of the known tool set, specifically by the other plier arm being formed by a blade extension, which is preferably approximately of the same length as the handle. Possible further tool components are constituted, in particular, by a blade extension of the handle formed as a screwdriver handle. The handle projection on the plier arm is formed as a hexagonal profile. A hexagonal chuck of the handle or of a further tool component may be plugged onto this hexagonal profile. The cross-sectional surface area of the blade extension is preferably greater than the cross-sectional surface area of the polygonal profile. The handling ability is improved as a result. The polygonal chuck is preferably a chuck with an axially displaceable sliding sleeve and a clamping body. The sliding sleeve keeps the clamping body, under spring action, in a clamping position. From this clamping position, the clamping body can be released by virtue of the sliding sleeve being displaced. Such a quick-change chuck is disclosed, for example, in Utility Model 90 00 245.8. Reference is made to this specification as far as the configuration of this chuck is concerned. It is considered, in particular, to be advantageous here if the clamping body, formed as a ball, rests, by way of its curved surface merely on the two corner points of the prismatic corner cutout of the polygonal profile. In a preferred development of the blade extension, it is provided that, at its end which is located opposite the chuck, this blade extension provides a transverse opening for the insertion of a polygonal profile of a further tool component. Possible further tool components are constituted, in particular, by screwdriver bits, nuts or angle elements. However, it is also provided that the tool components are formed by knives or saws. These tool components have, at their end, a polygonal profile which can be inserted into the polygonal opening of the quick-change chuck. The length of the handle-end arm segments of the plier head is preferably less than the length of the jaw-end arm end segments. The two plier arms are preferably formed as forgings. It is possible here for the jaws to have a Rockwell hardness of 60 or more. It is sufficient if the handle projections have a Rockwell hardness of approximately 45. The plier jaws may have a flat tip. However, they may also have a cutting edge. It is likewise provided that the plier jaws provide a rounded jaw segment. It is preferable for the jaws to provide the flat zone at the tip and the cutting edge adjacent to the knuckle joint. A rounded region may be formed between the cutting edge and the flat tip. In order for the quick-change chuck to be connected to the handle projections in an axially secured manner, it is provided that the arm projections, which are formed as polygonal stubs, provide radial cutouts for the engagement of the clamping body. The handle-end plier arm segments may be angled such that the axial lines of the arm projections intersect at a point which is located in front of the plier knuckle joint, at the jaw end. As a result of the handle projections being located directly adjacent to the knuckle joint, the plier head is of very small construction. The handle projections, which are inserted into the chuck, are continuations of angled portions which directly adjoin the knuckle joint. The handle projections are profiled such that handles which can be plugged thereon are connected to the plier head in a pull-resistant and compression-resistant manner. In the case of the plier head according to the invention, it is ensured that the functional elements of a set of pliers can be produced in a conventional, tried-and-tested manner. The tool components which perform the handle function have multiple uses, in that they can also be combined with other tool components and, in particular, with each other. The polygonal profile may be the standardized ¼-inch hexagonal profiles which are realized for the screwdriver bits. However, the subject matter of the invention also covers, in principle, any other standard polygonal drive profile, in particular also ¼-inch square profiles which are used as ratchet drive profiles. The tool set may include adapter elements in order for a ¼-inch hexagonal socket to be accommodated over a ¼-inch square profile.

The plier head is produced in a known manner by forging long-armed pliers. The plier arms are then cut off to leave just stub-like plier-arm segments. A hexagonal profile is then machined onto these plier-arm segments. The hexagonal profile is applied with the plier mouth open. In this case, the two handle-end plier-arm end segments are located at such an angle as to make it possible for the profiling of the polygonal segments to be machined.

BRIEF DESCRIPTION OF THE DRAWINGS

Exemplary embodiments of the invention are explained hereinbelow with reference to the attached drawing, in which:

FIG. 8 shows the handle combined with a blade extension and a nut plugged thereon, FIG. 9 shows two blade extensions combined as an angled handle.

DETAILED DESCRIPTION OF THE PREFERRED EMBODIMENT

Figure 1:
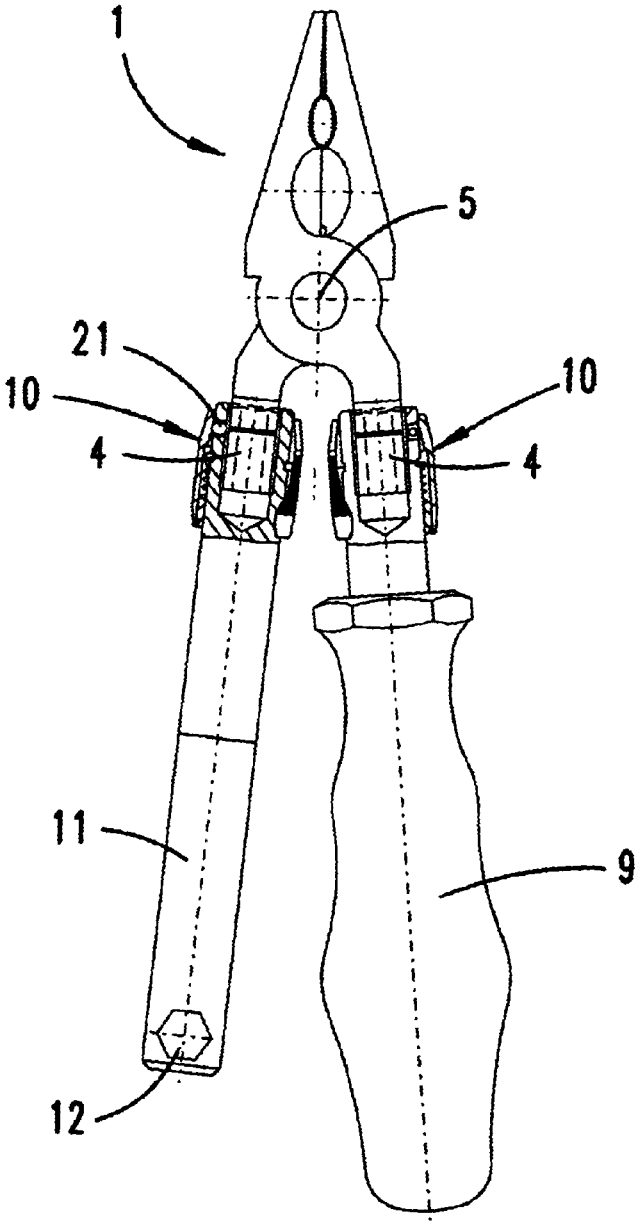
FIG. 1 shows a plier head, the handle projections of which are combined with tool components and/or a handle
Figure 2:
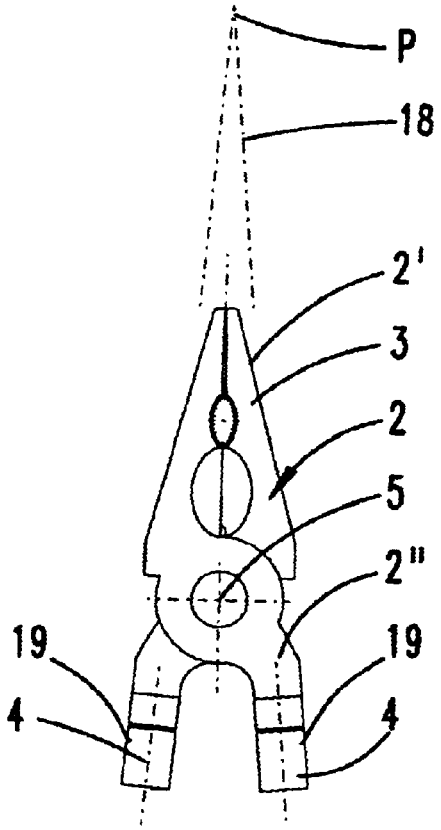
FIG. 2 shows the plier head in the closed position.
Figure 3:
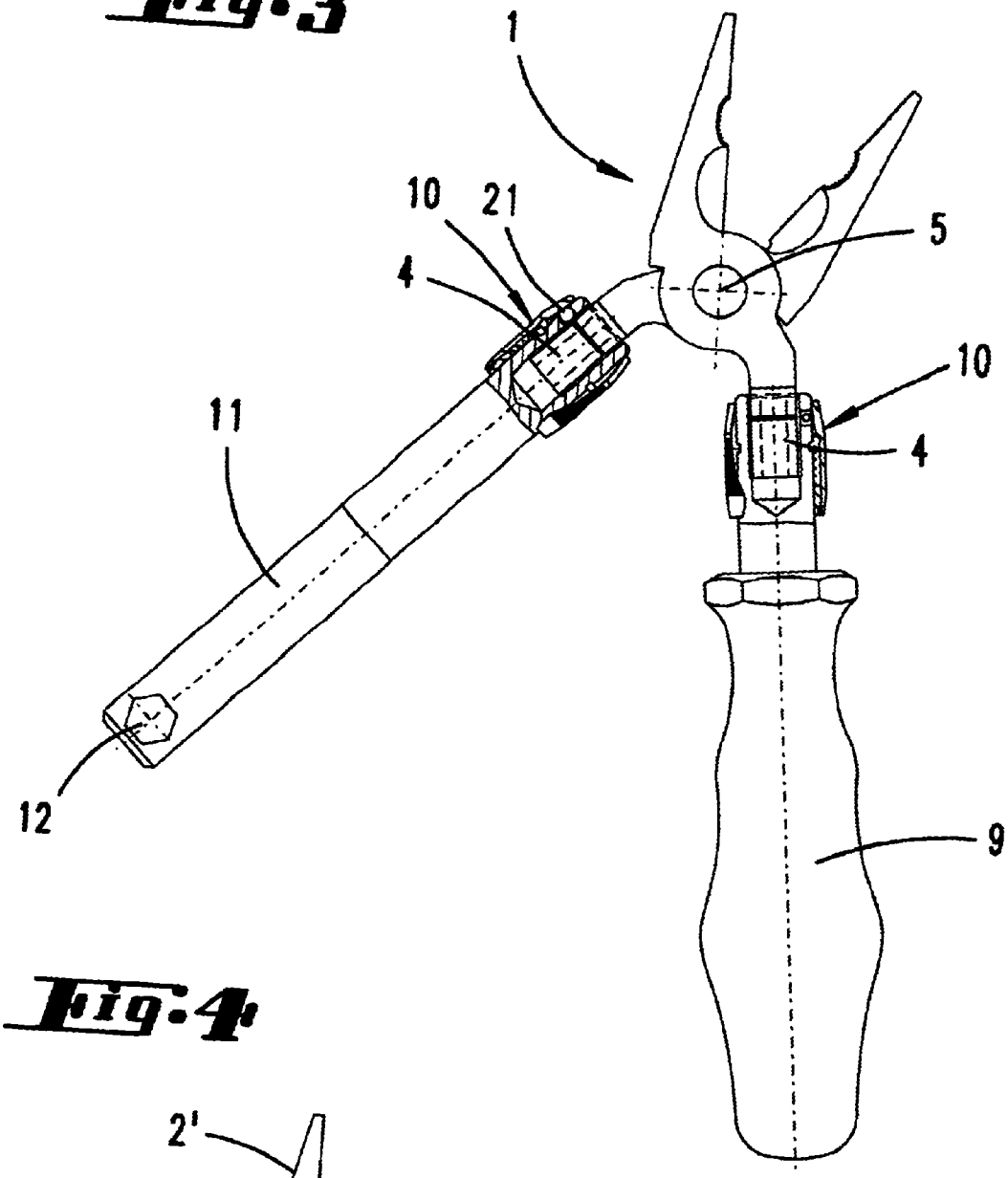
FIG. 3 shows an illustration according to FIG. 1 with the pliers open.
Figure 4:
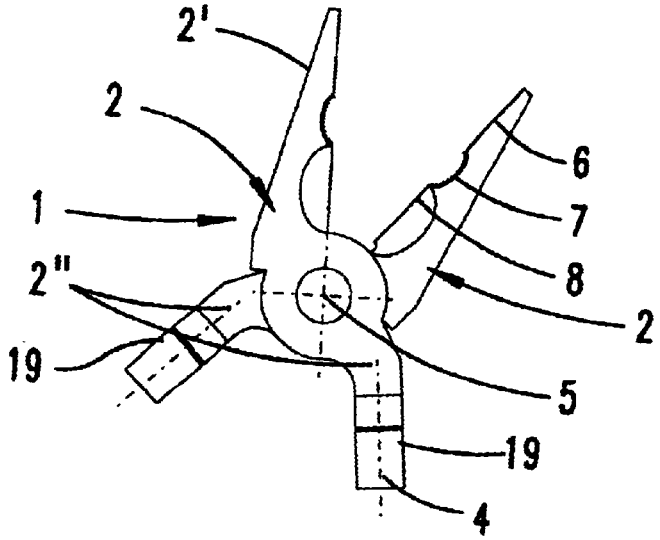
FIG. 4 shows the plier head in the open position.
Figure 5:
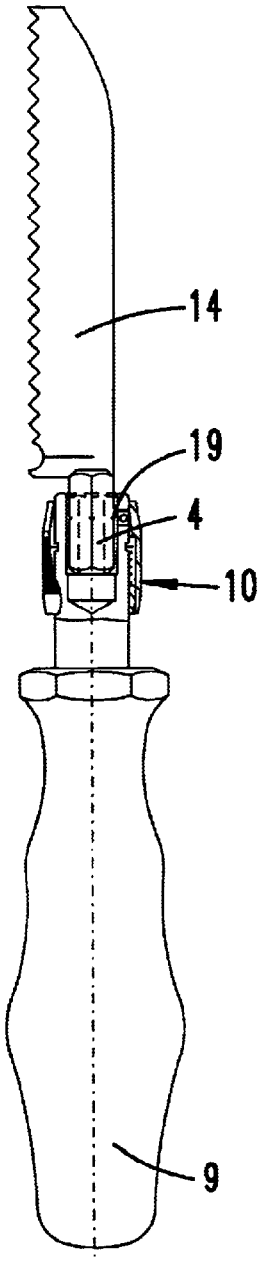
FIG. 5 shows the handle combined with a saw.
Figure 6:
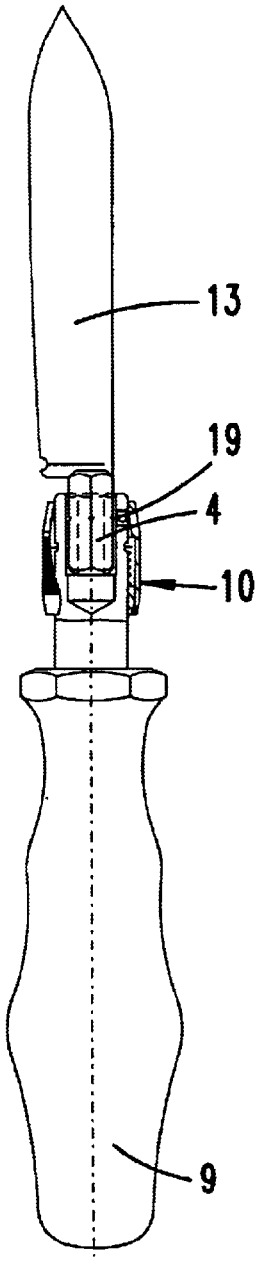
FIG. 6 shows the handle combined with a knife.
Figure 7:
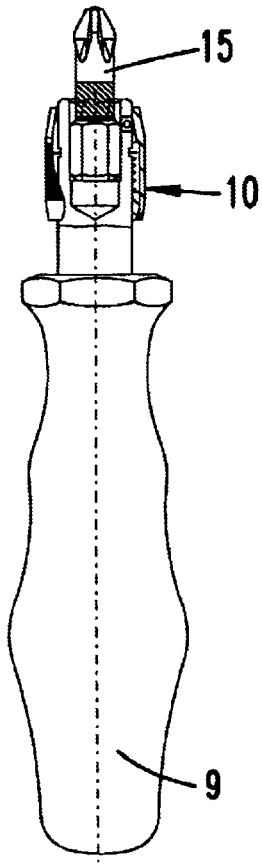
FIG. 7 shows the handle combined with a Phillips screwdriver insert.

The plier head 1 according to the invention has two plier arms 2 crossing over at the articulation or knuckle joint 5. Each plier arm 2 forms a jaw 3 by way of its jaw end segment 2'. By way of its handle segment 2", which is located opposite the jaw 3, each plier arm 2 forms a handle projection 4.

The handle projection 4 is formed as a prismatic hexagonal segment. The hexagonal profile is produced by machining. The length of the handle-end arm segment 2" is shorter than the length of the jaw-end arm segment 2', which forms the jaws 3.

The plier head 1 illustrated in the exemplary embodiment forms a set of universal pliers. At the tip end, the jaw 3 has a flat segment 6 which comes into surface abutment with the opposite segment. In the direction of the knuckle joint 5, the jaw continues into a round grooved segment 7. A cutting edge 8 is located between the round segment 7 and the knuckle joint 5.

The invention also relates to pliers with differently configured jaws. In particular, it is also possible for the jaws to form scissor jaws.

The handle-end plier-arm segments 2" are angled slightly, so that the axial lines 18 of the handle projections 4 intersect at a point P which is located in front of the knuckle joint 5 and, in particular, in front of the tip of the jaw 3. As a result, in the closed position of the pliers, the plugged-on handle arms 9, 11 define an acute angle.

Figure 12:
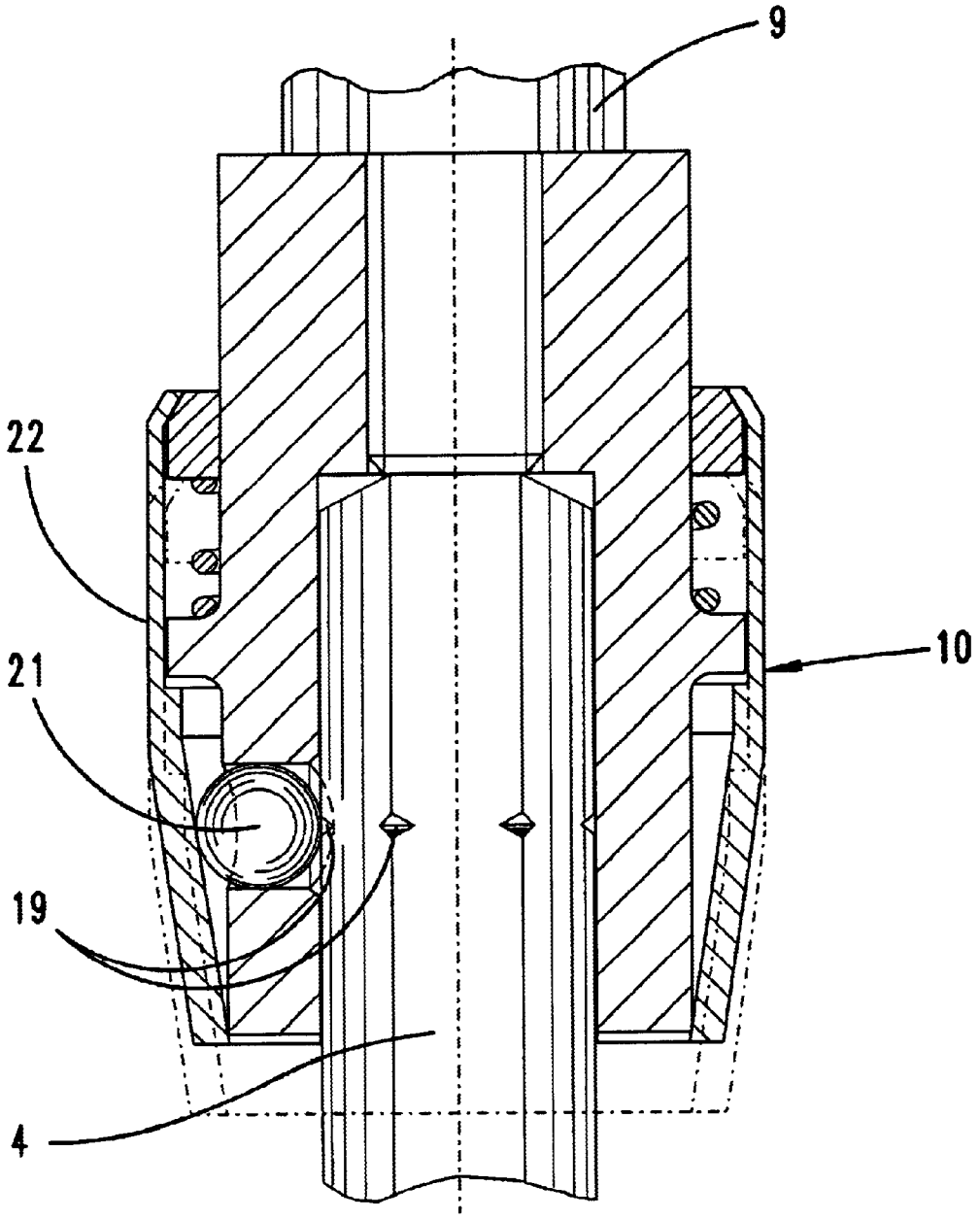
FIG. 12 shows an enlarged sectional illustration of a quick-change chuck.

It is possible for handle parts to be plugged onto the handle projections 4. Separation of the plier head and handle part makes it possible to achieve a very small overall size for the functional part, the plier head 1. A fully functional set of pliers is easily achieved by virtue of the handles being plugged onto the handle projections 4. As is illustrated in FIG. 12, the handle parts preferably have a quick-change chuck, by way of which they can be plugged onto the polygonal handle projections 4. The handle projections 4 have cutouts into which clamping bodies can latch, so that the handle parts are secured axially.

The plier head 1 according to the invention is preferably used in a tool set which comprises a plurality of tool components. The tool components, for example a saw 14 or a knife 13 and a bit 15 or a socket 16 may be combined with a screwdriver handle 9 has a quick change chuck 10 at one end, as is illustrated in FIG. 12.

The quick-change chuck is described in detail in Utility Model 90 00 245.8. It has a hexagonal accommodating cavity with a radial window. In this window, clamping bodies 21 in the form of a ball are located in front of bearing shoulders. This ball may pass into the cavity in part and interacts with the prismatic corner cutouts 19 of the polygonal insertion profile. Also provided is a sliding sleeve 22 with an oblique surface on its inside wall, this oblique surface acting on the clamping body 21. The sleeve 22 is resiliently mounted and keeps the clamping body 21 in the clamping position by means of the spring force. If the sleeve 22 is displaced, then the clamping body 21 can yield in order to release the polygonal segment.

Figure 11:
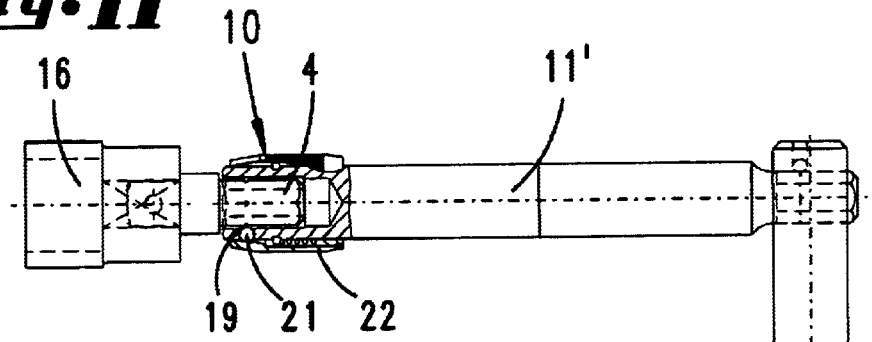
FIG. 11 shows the handle combined with an extension element as an angle handle.

The tool set includes not just the handle 9, but also an angle element 11 and a extension element 11'. The angle element 11 and extension element 11' likewise have a quick-change chuck 10 at the end. The angle element 11 has, at its other end, a polygonal opening 12 for the insertion of, for example, the polygonal segment of the extension element 11' (see FIGS. 9 and 11).

The knife defines a polygonal segment 19 for insertion into one of the quick-change chucks 10. The saw 14 is configured in the same way.

Figure 10:
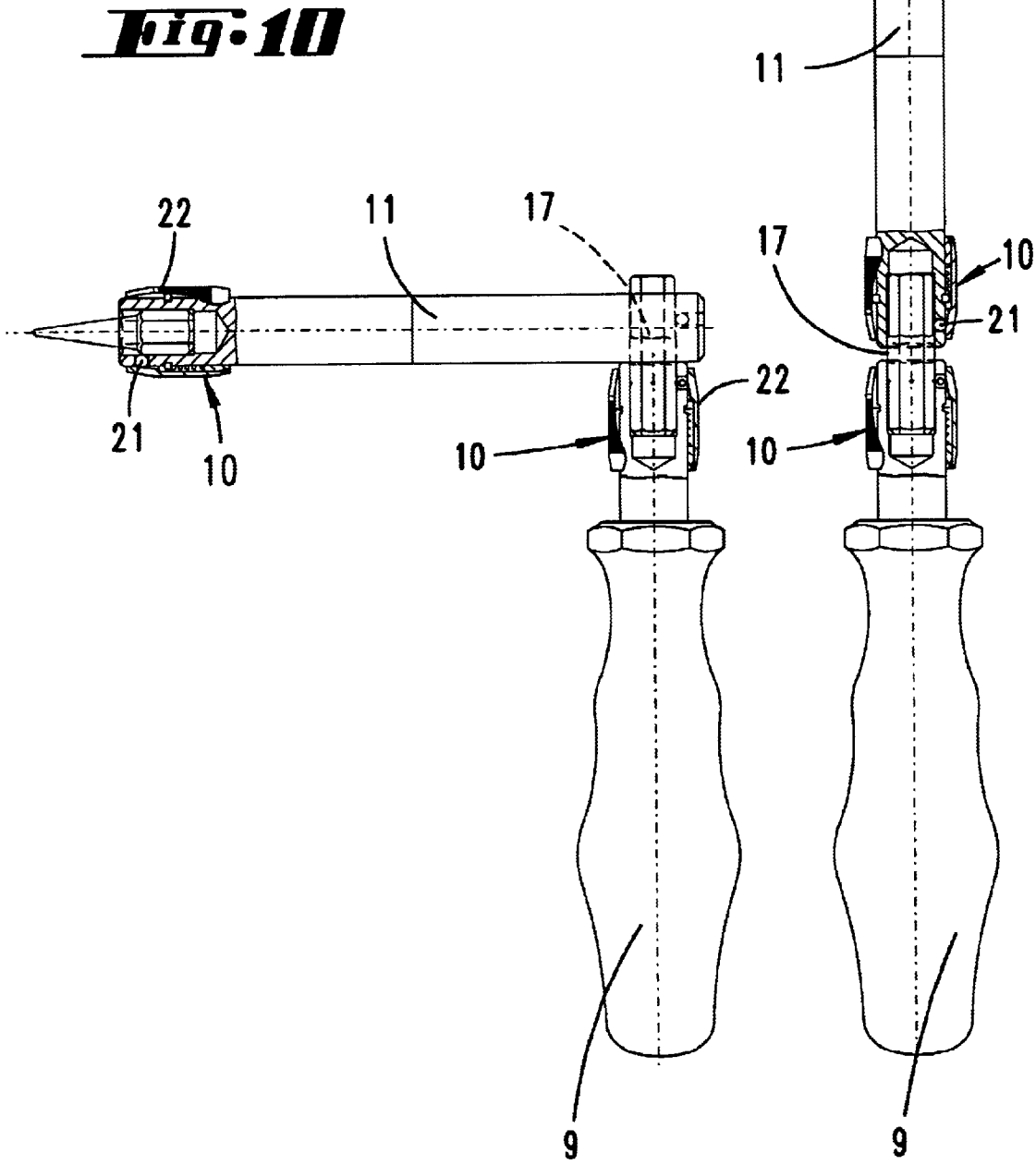
FIG. 10 shows the handle combined with a blade extension as an angle element.

The tool set further includes a polygonal bit 17, which forms the same profile at both its ends. It may also form a latching ball at one end. This polygonal bit 17 is intended to connect two chucks flush against one another or, as is illustrated in FIG. 10, to connect the angle 11 directly to the screwdriver handle 9.

We claim:

1. A tool set having a screwdriver handle with a chuck for insertion and latched mounting of screwing-tool inserts provided with standard polygonal shank segments, and having screwing-tool inserts, which are insertable into the chuck and are provided with the standard polygonal shank segments, said inserts are at least one of screwdriver bits, sockets, and extensions for driving of said insert, a supplementary tool which has a plier head (2) and plier-handle projections (4) which is disposed immediately behind a knuckle joint (5) and are in form of the standard shank segment of the screwing-tool inserts, the screwdriver handle (9) latches to the plier-handle projection by said chuck (10), forming one of two plier arms and an angle element (11) which likewise has a chuck (10), forming other of the two plier arms wherein at an end opposite the chuck, said angel element has a transverse opening (12) for insertion of a polygonal shank segment of a further tool component or said inserts.

2. The tool set as claimed in claim 1, wherein a cross-sectional surface area of the angle element (11) is greater than a cross-sectional surface area, of the polygonal shank segments.

3. The tool set as claimed in claim 1, wherein the chuck is a quick-change chuck provided with an axially displaceable sliding sleeve (22) and clamping body (21), the sliding sleeve (22) forcing the clamping body (21), under spring action, into a clamping position, from which the clamping body (21) is releasable by the sliding sleeve (22) being displaced.

4. The tool set as claimed in claim 1, wherein said further tool component is an extension element (11') having a chuck (10) at one end and a polygonal shank segment (19) at another end.

5. The tool set as claimed in claim 1, wherein said further tool component has a polygonal-profile insertion end and is formed as a knife (13) or saw (14).

6. The tool set as claimed in claim 1, wherein said plier-handle projections includes handle-end arm segments (2") and said plier head includes jaw-end arm segments (2'), wherein a length of said handle-end arm segments is less than a length of said jaw-end arm segments.

7. The tool set as claimed in claim 1, wherein two plier arms (2) are produced as forging.

8. The tool set as claimed in claim 1, wherein said plier head (2) further comprises plier jaws (3) having a flat tip (6).

9. The tool set as claimed in claim 8, wherein the plier jaws (3) form a cutting edge (8).

10. The tool set as claimed in claim 8, wherein the plier jaws (3) form a rounded jaw-profile segment (7).

11. The tool set as claimed in claim 3, wherein the projections (4) are, which is formed as a hexagonal or square profile, having a radial cutout (19) for engagement of the clamping body (21).

12. The tool set as claimed in claim 1, wherein a longitudinal axis (18) of the projections (4) intersect at a point (P) which is located at a predetermined distance from the plier knuckle joint (5), at a jaw end thereof.

13. The tool set as claimed in claim 1, wherein the plier-handle projections (4), which are insertable in the chucks (10), are continuations handle-end arm segments (2) which are adjacent to and extend from the knuckle joint (5), said plier-handle projection locks with the chucks in a pull-resistant and compression-resistant manner.

* * * * *

UNITED STATES PATENT AND TRADEMARK OFFICE

CERTIFICATE OF CORRECTION

PATENT NO. : 6,643,877 B1
DATED : November 11, 2003
INVENTOR(S) : Amtenbrink et al.

It is certified that error appears in the above-identified patent and that said Letters Patent is hereby corrected as shown below:

Title page,
Item [30], Foreign Application Priority Data, change
"Sep. 21, 1999 (DE) .....299 16 538" to
-- Sep. 21, 1999 (DE) .....299 16 588 --

Signed and Sealed this

Eleventh Day of May, 2004

JON W. DUDAS
*Acting Director of the United States Patent and Trademark Office*